US007537076B2

(12) United States Patent
Falkiner

(10) Patent No.: US 7,537,076 B2
(45) Date of Patent: May 26, 2009

(54) COMBINED GOLF CADDIE AND GOLF CART

(75) Inventor: Thomas L. Falkiner, 66 Bertie Street, Fort Erie, Ontario (CA) L2A 1X9

(73) Assignee: Thomas L. Falkiner, Fort Erie, Ontario (CA)

( * ) Notice: Subject to any disclaimer, the term of this patent is extended or adjusted under 35 U.S.C. 154(b) by 66 days.

(21) Appl. No.: 11/459,474

(22) Filed: Jul. 24, 2006

(65) Prior Publication Data

US 2008/0023236 A1 Jan. 31, 2008

(51) Int. Cl.
*B62D 61/00* (2006.01)
*B62K 15/00* (2006.01)

(52) U.S. Cl. ..... 180/208; 180/217; 180/65.1; 280/DIG. 5; 280/651

(58) Field of Classification Search ..... 180/208, 180/210, 216, 19.2, 19.3, 65.1, 11, 219, 217; 280/DIG. 5, DIG. 6, 651, 652
See application file for complete search history.

(56) References Cited

U.S. PATENT DOCUMENTS

| | | | | | |
|---|---|---|---|---|---|
| 2,918,134 | A | * | 12/1959 | Jensen | 180/216 |
| 3,369,629 | A | * | 2/1968 | Weiss | 180/208 |
| 3,388,761 | A | * | 6/1968 | Arpin | 180/208 |
| 3,580,349 | A | * | 5/1971 | Brennan et al. | 180/208 |
| 3,605,929 | A | | 9/1971 | Rolland | |
| 3,608,659 | A | * | 9/1971 | Gardner | 180/19.3 |
| 3,948,332 | A | | 4/1976 | Tyner | |
| 4,431,205 | A | | 2/1984 | Speicher et al. | |
| 4,533,013 | A | | 8/1985 | Hightower | |
| 4,757,868 | A | * | 7/1988 | Cresswell | 180/11 |
| 4,861,058 | A | * | 8/1989 | Cresswell | 280/278 |
| 4,874,055 | A | * | 10/1989 | Beer | 180/19.2 |
| 5,036,938 | A | * | 8/1991 | Blount et al. | 180/208 |
| 5,228,533 | A | * | 7/1993 | Mitchell | 180/208 |
| 5,277,267 | A | * | 1/1994 | Tiffany | 180/208 |
| 5,307,889 | A | * | 5/1994 | Bohannan | 180/19.2 |
| 5,346,028 | A | | 9/1994 | Cassano | |
| 5,388,659 | A | * | 2/1995 | Pepe | 180/219 |
| 5,526,894 | A | | 6/1996 | Wang | |
| 5,727,642 | A | * | 3/1998 | Abbott | 180/65.1 |
| 5,816,614 | A | * | 10/1998 | Kramer et al. | 180/208 |
| 5,879,022 | A | | 3/1999 | Winton | |
| 6,273,206 | B1 | * | 8/2001 | Bussinger | 180/208 |
| 6,276,470 | B1 | | 8/2001 | Andreae, Jr. et al. | |
| 6,474,427 | B1 | | 11/2002 | Tunnecliff | |
| 6,659,208 | B2 | | 12/2003 | Gaffney et al. | |
| 6,659,210 | B2 | | 12/2003 | Tyson | |

(Continued)

FOREIGN PATENT DOCUMENTS

DE 8619830 U1 12/1986

(Continued)

*Primary Examiner*—Hau V Phan
(74) *Attorney, Agent, or Firm*—Hodgson Russ LLP

(57) ABSTRACT

A combined golf caddie and golf cart apparatus comprises a frame configured to support a golf bag, and a steering assembly which pivots with respect to the frame to adjust between a walk position and a ride position. A seat is removably mounted on the frame by support legs, wherein the support legs and the seat straddle a golf bag supported by the frame to maintain a very compact apparatus in the ride position and in the walk position.

18 Claims, 4 Drawing Sheets

U.S. PATENT DOCUMENTS

| | | | | |
|---|---|---|---|---|
| 6,695,081 | B2 * | 2/2004 | Chu et al. | 180/65.1 |
| 7,210,705 | B2 * | 5/2007 | Chen et al. | 180/65.1 |
| 2004/0188984 | A1 | 9/2004 | Cassoni | |

FOREIGN PATENT DOCUMENTS

| | | | |
|---|---|---|---|
| GB | 2127364 | A | 4/1984 |
| JP | 8322976 | A | 12/1996 |
| WO | 2004031016 | A1 | 4/2004 |

* cited by examiner

FIG. 5
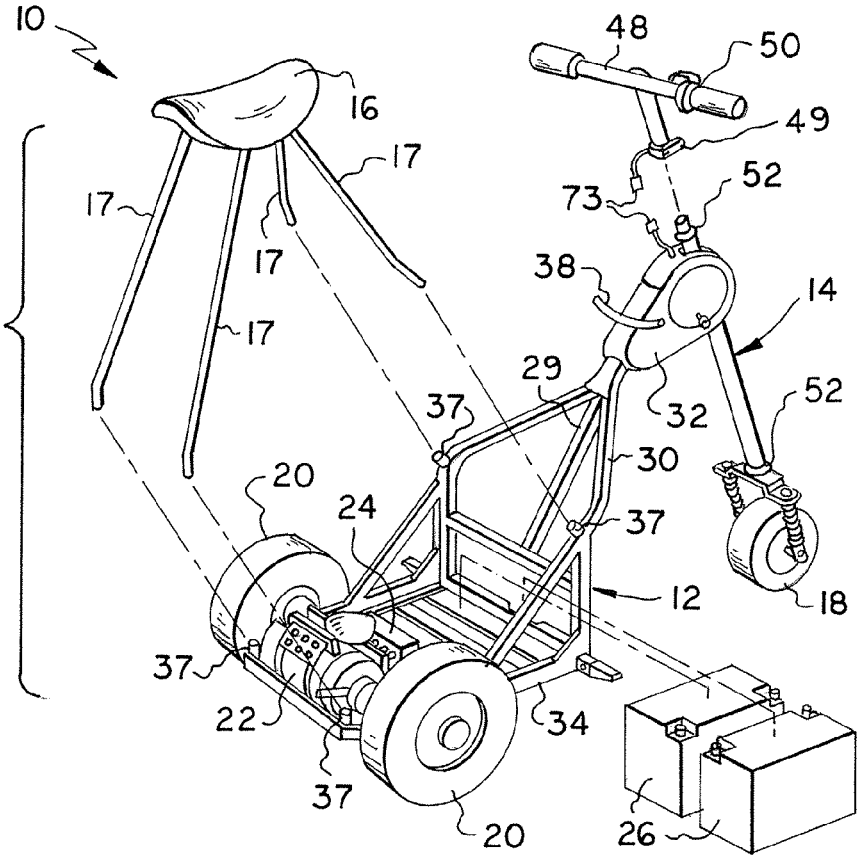
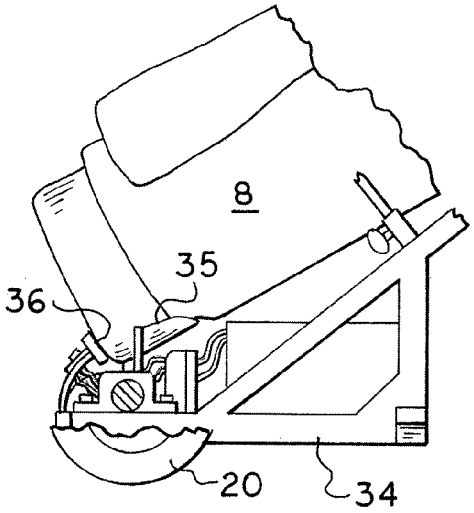
FIG. 3
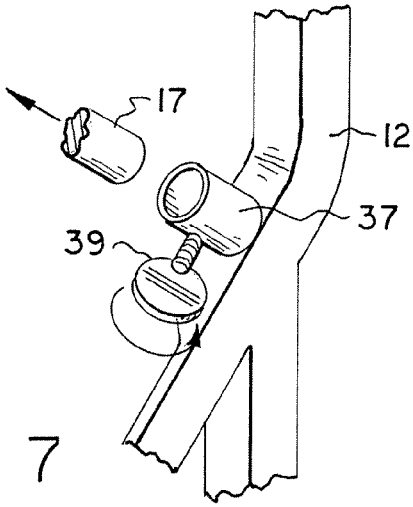
FIG. 7

FIG. 6
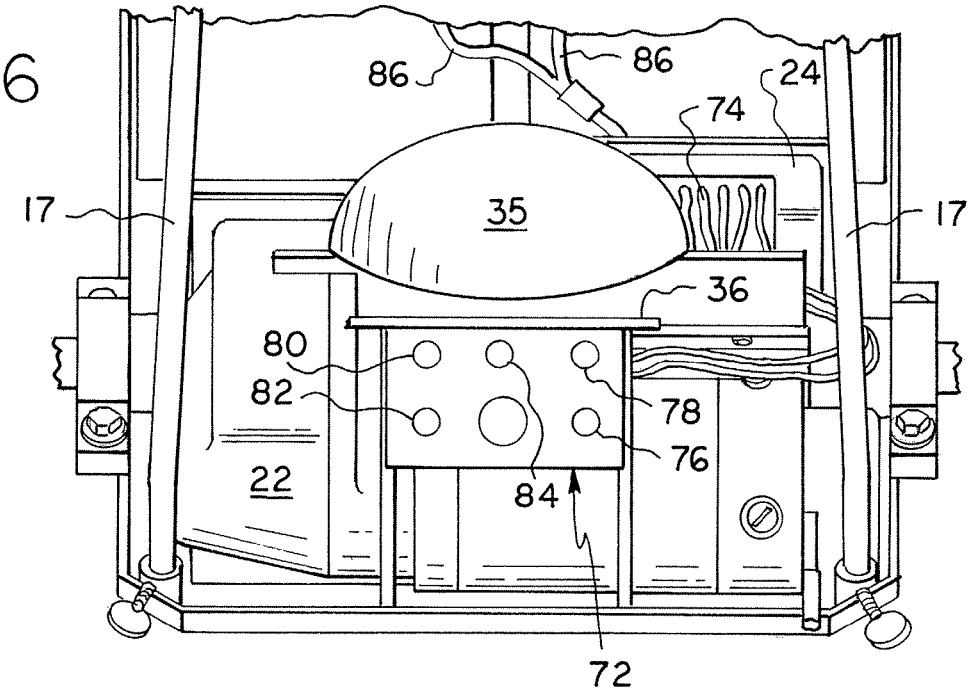
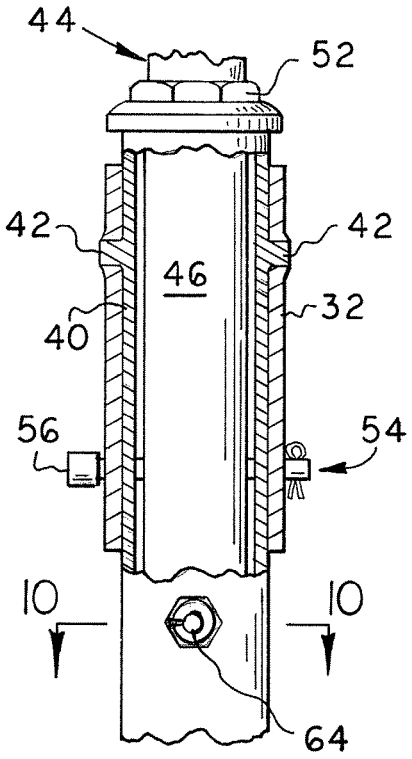
FIG. 9
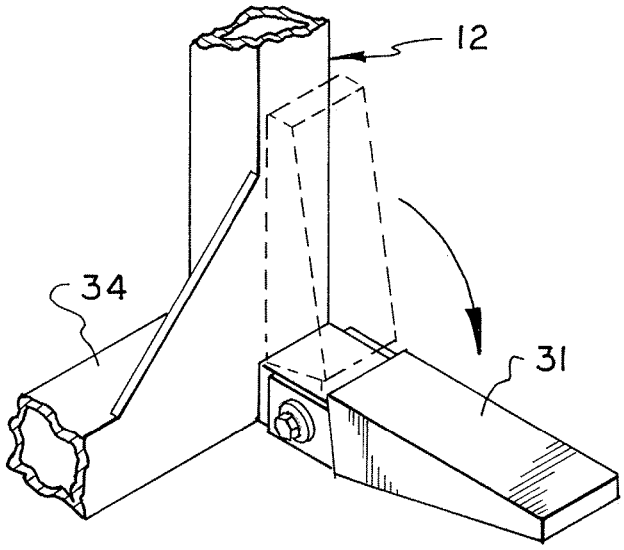
FIG. 8

FIG. 10A
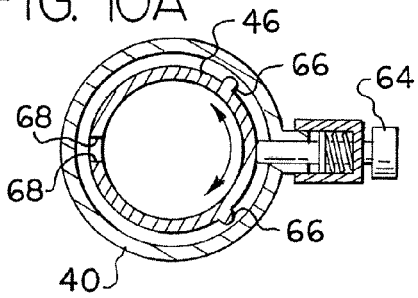
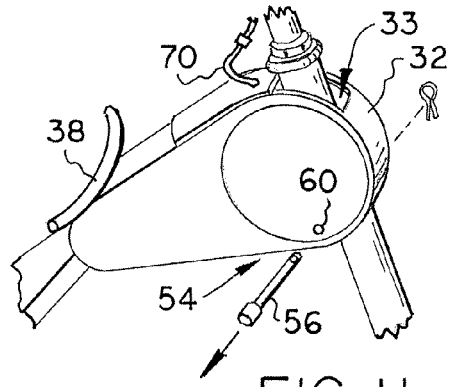
FIG. 11
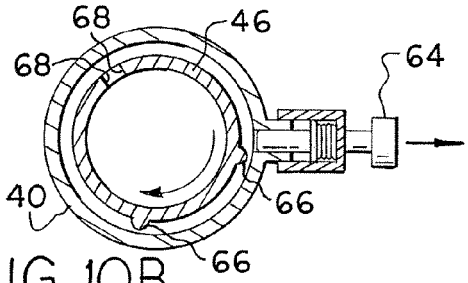
FIG. 10B
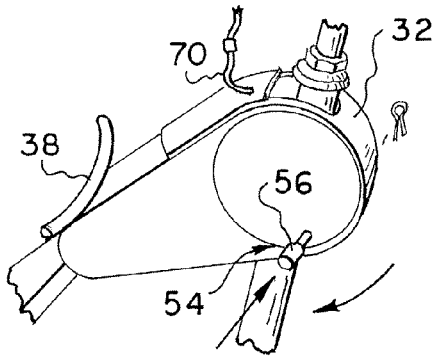
FIG. 12
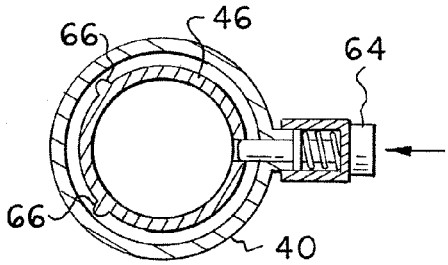
FIG. 10C
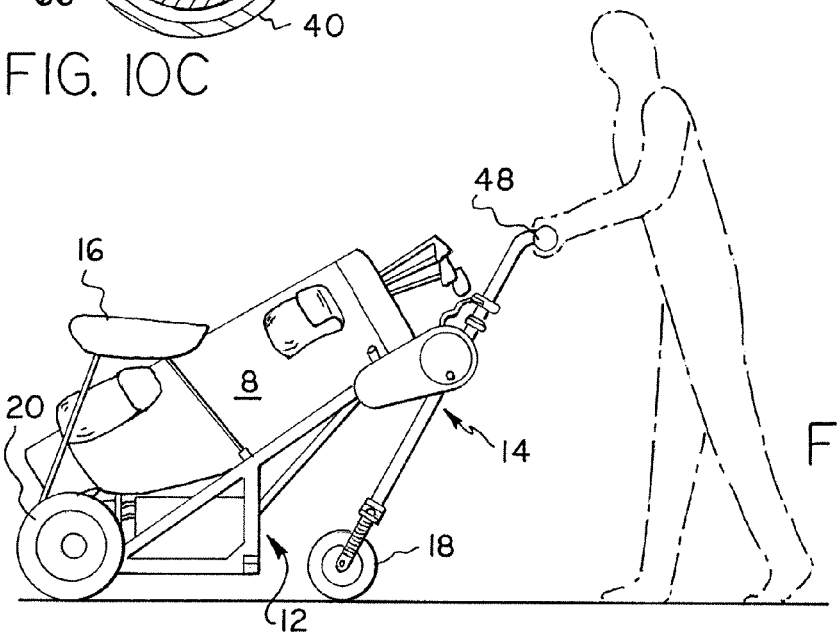
FIG. 13

COMBINED GOLF CADDIE AND GOLF CART

FIELD OF THE INVENTION

The invention relates generally to wheeled golf caddies and golf carts, and more particularly to an apparatus operable as either a caddie which may be pushed and pulled, or a cart which may be ridden.

BACKGROUND OF THE INVENTION

Golf caddies typically comprising two or three ground-engaging wheels, a frame configured for receiving a golf bag, one or more straps or other means for fastening the golf bag, and an upper handlebar are commonplace. Such caddies are pulled or pushed along by golf players who walk, rather than ride a cart, during a round of golf.

Automatically powered golf carts are also commonplace. Typically, these have four ground-engaging wheels, a chassis with seats for multiple players and space at the rear to hold golf bags, a drive motor, a power source, and controls for steering and operating the motor.

Powered caddies are also known. Examples may be found in U.S. Pat. Nos. 3,948,332; 5,526,894; 6,276,470. A further caddie of this variety is taught by U.S. Pat. No. 6,659,208, which describes a seat attachable to the caddie for use when the caddie is not operating.

U.S. Pat. No. 5,879,022 discloses a golf bag that converts into a non-powered golf caddie.

The caddie and cart devices of the prior art do not allow a player to switch between walking and riding during a round of golf, except by exchanging a caddie for a cart or vice versa. Having the option to switch between walking and riding may be desirable in some instances. For example, players who experience difficulty walking long distances, but enjoy and benefit from walking shorter distances, may wish to switch from walking to riding during a round. As another example, a sudden thunderstorm may necessitate fast evacuation from the course, in which case a walking player would readily forego the exercise of walking back to the clubhouse in favor of a speedy ride to the clubhouse. As yet another example, if speed of play of groups ahead and/or behind is fast, players may wish to ride to keep up, but if it is slow, they may wish to walk.

Therefore, it would be desirable to provide an apparatus that carries a golf bag and gives a player an option of whether to ride or walk at any given time during a round of golf.

SUMMARY OF THE INVENTION

It is an object of the present invention to provide an apparatus that converts quickly and easily between a golf cart for allowing a player to ride, and a golf caddie for transporting a golf bag while a player walks the golf course.

It is another object of the present invention to provide a convertible golf cart/golf caddie apparatus that is capable of compact storage and transport, for example in the trunk of a car.

It is another object of the present invention to provide a ridable golf cart that is size and space efficient.

It is a further object of the present invention to provide a golf caddie that can be operated with the help of a motor drive or alternatively operated without motor drive.

In furtherance of these and other objects, a combined golf caddie and golf cart apparatus is described. The apparatus generally comprises a frame configured to support a golf bag, and a steering assembly which pivots with respect to the frame to adjust between a walk position in which a handlebar of the steering assembly is ahead of a front steering wheel of the steering assembly and a ride position in which the handlebar trails the steering wheel. A motor and power source are carried by the frame for driving one or both of a pair of rear wheels mounted on the frame in response to control signals from a motor controller taking input from a throttle control on the handlebar. In a preferred embodiment, the frame includes an outer casing, the steering assembly includes a steering tube pivotally mounted to the outer casing, and means are provided for releasably locking the steering assembly in either the walk position or the ride position as desired.

In another aspect of the invention according to a preferred embodiment, a seat is removably mounted on the frame by support legs, wherein the support legs and the seat straddle a golf bag supported by the frame for compact design.

Preferably, a detent member is arranged to extend radially through the steering tube to partially reside between a pair of angularly spaced limit surfaces provided on a steering column of the steering assembly, whereby rotation of the steering column relative to the steering tube is limited to a predetermined angular range.

The apparatus of the present invention may be ridden with motor drive or used as a walk caddie with or without motor drive.

BRIEF DESCRIPTION OF THE DRAWINGS

The nature and mode of operation of the present invention will now be more fully described in the following detailed description of the invention taken with the accompanying drawing figures, in which:

FIG. 3 is a side elevational view showing a rear portion of the apparatus;

FIG. 5 is an exploded rear perspective view of the apparatus;

FIG. 6 is a rear view of the apparatus showing a motor control panel thereof;

FIG. 7 is an enlarged view showing a preferred arrangement for detachably mounting a seat support leg to a frame of the apparatus;

FIG. 8 is an enlarged view showing a fold-out foot peg on the frame of the apparatus;

FIG. 9 is a sectional view taken generally along the line 9-9 in FIG. 2;

FIGS. 10A-10C are a series of sectional views taken generally along the line 10-10 in FIG. 9 to illustrate a detent mechanism for limiting rotation of a steering assembly of the apparatus;

FIG. 11 is an enlarged view showing the steering assembly in a ride position relative to the frame;

FIG. 12 is a view similar to that of FIG. 11, but showing the steering assembly pivoted to a walk position relative to the frame; and FIG. 13 is a side elevational view of the apparatus similar to that of FIG. 2, with a walker indicated.

DETAILED DESCRIPTION OF THE INVENTION

Figure 1:
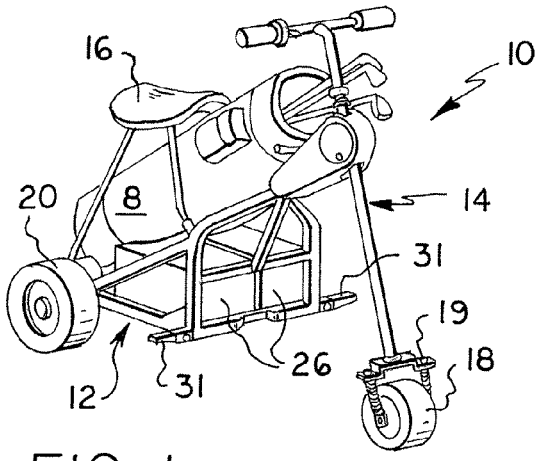
FIG. 1 is a front perspective view of a combined golf caddie and golf cart apparatus formed in accordance with an embodiment of the present invention, shown in a ride position thereof carrying a golf bag.

Attention is directed initially to FIGS. 1-5 of the drawings, wherein a combined golf caddie and golf cart apparatus formed in accordance with an embodiment of the present invention is shown and designated broadly by reference numeral 10. Apparatus 10 generally comprises a frame 12, a steering assembly 14, a seat 16, a front steering wheel 18 forming part of steering assembly 14, a pair of rear wheels 20, a motor 22, a motor controller 24, and a pair of power sources 26.

Frame 12 is constructed of a durable rigid material, preferably metal, and includes an inverted Y-shaped main member 30, an outer casing 32 provided at an upper portion of the main member 30 and having a passage 33 (FIG. 11) through which steering assembly 14 passes, and a platform portion 34 fixed to and depending from a lower portion of the main member 30. Frame 12 is configured to support a golf bag 8 (not a part of the present invention) in an inclined position. For this purpose, a curved bag support 35 and a bag stop member 36 are provided at a rear area of platform portion 34 to engage a lower end of golf bag 8, and a transverse cradle member 38 is fixed to outer casing 32 near the junction of outer casing 32 with main member 30 to engage and support an upper portion of golf bag 8. Frame 12 preferably includes a central member 29 extending from main member 30 to join with platform portion 34. Alternative configurations of frame 12 designed to support a golf bag are of course possible, and any configuration that supports a golf bag may be used. A pair of fold-out foot pegs 31, one of which is shown in FIG. 8, are fixed to opposite sides of horizontal platform portion 34 to support the feet of a rider.

In accordance with the present invention, steering assembly 14 extends through passage 33 in outer casing 32 of frame 12 and is mounted to pivot with respect to the frame to adjust back and forth between a ride position (FIG. 2) and a walk position (FIG. 13). More particularly, and with reference to FIG. 9, steering assembly 14 includes a steering tube 40 pivotally mounted to the outer casing 32 of the frame 12 by a pair of pivot pins 42 extending in opposite directions from an outer wall of steering tube 40 and received by corresponding holes in outer casing 32. Steering assembly 14 further includes a steering column 44 carried by steering tube 40 such that the steering column is allowed to rotate about the longitudinal axis of steering tube 40. Steering column 44 has an elongated steering axle 46 arranged to extend through steering tube 40 and a handlebar 48 mounted on an upper portion of the steering axle. Steering wheel 18 is shown mounted on a lower portion of steering axle 46 by a fork suspension 19, however other arrangements for mounting steering wheel 18 may be used. Steering axle 46 is prevented from axially directed sliding movement relative to steering tube 40 by upper and lower journal nuts 52, but steering axle 46 is free to rotate with respect to steering tube 40 about their shared longitudinal axis. As will be understood, a user may turn handlebar 48 to rotate the steering column 44, including steering wheel 18, to change the direction of travel of apparatus 10. Moreover, steering assembly 14 pivots with respect to frame 12 to adjust between the walk position of FIG. 13 in which handlebar 48 is ahead of steering wheel 18 and a ride position of FIG. 2 in which handlebar 48 trails steering wheel 18. As indicated in FIG. 5, handlebar 48 is removably mounted on steering axle 46, such as by a lever-operated clamp 49 or quill stem connection, so that handlebar 48 may be quickly mounted for use or removed if necessary for storage.

In order to releasably secure steering assembly 14 in the walk position and alternatively in the ride position, whichever is selected, a locking means 54 is provided. In the embodiment shown at FIGS. 9, 11, and 12, locking means 54 includes a removable locking pin 56 insertable through a pair of aligned holes 60 through opposite sides of outer casing 32. Locking pin 56 may have an enlarged head at one end and a through-hole at the other for receiving a cotter pin or similar device for keeping the locking pin in place after insertion. When in place, locking pin 56 abuts against steering tube 40 to confine it, with the cooperation of outer casing 32, against further pivotal motion with respect to casing 32. Holes 60 are located such that confinement occurs when steering assembly is in both the walk position and the ride position; alternatively, two pairs of aligned holes, one pair for the walk position and one pair for the ride position, may be used. Other means for releasably securing steering assembly 14 in the walk position or ride position include spring biased plungers and other locking mechanisms arranged to act between outer casing 32 and steering assembly 14.

The extent to which steering column 44, including steering wheel 18, can be rotated relative to steering tube 40 is preferably limited to an angular range that allows sufficient directional steering of apparatus 10 but minimizes the risk of tipping. In some situations, such as when steering assembly 14 is in the walk position or during storage of assembly 10, it may be desirable to entirely prevent rotation of steering column 44 relative to steering tube 40. Accordingly, apparatus 10 is preferably equipped with a detent member 64 shown in FIGS. 10A-10C. Detent member 64 is arranged to extend radially through a hole in steering tube 40 to partially reside between a pair of first limit surfaces 66 or between a pair of second limit surfaces 68 provided on steering axle 46. In a preferred embodiment, second limit surfaces 68 have an axis of symmetry that is 180° opposite an axis of symmetry of first limit surfaces 66. As will be understood, when an inner end portion of detent member 64 is between first limit surfaces 66 as shown in FIG. 10A, steering column 44 may be rotated about 22.5° to either side from a centrally aligned position until a corresponding one of the first limit surfaces 66 engages detent member 64, thereby allowing a limited range of steering to the left and to the right. Preferably, detent member 64 is in the form of a plunger mounted on steering tube 40 and spring-biased in a radially inward direction toward steering axle 46. Detent member 64 may be pulled radially outward against the spring bias and steering column 44 rotated through as depicted in FIG. 10B, to position second limit surfaces 68 adjacent detent member 64, such that when detent member 64 is again allowed to move radially inward under the biasing force, the inner end portion of detent member 64 will reside between second limit surfaces 68 as shown in FIG. 10C. In the depicted embodiment, second limit surfaces 68 are spaced close together to prevent rotation of steering column 44 relative to steering tube 40, however second limit surfaces 68 may be spaced to allow some range of rotation as a matter of design choice.

Seat 16 is removably mounted on frame 12 by support legs 17 whose distal ends are received in respective mounting receptacles 37 provided on frame 12. As best seen in FIG. 7, mounting receptacles 37 each have a thumb screw 39 extending through a threaded hole in the receptacle wall for releasably clamping a received support leg in the receptacle. Of course, other means for releasable securing support legs 17 in receptacles 37 may be used, including without limitation pins, lever-operated cams, latches, clips, friction members, and snap members.

Figure 2:
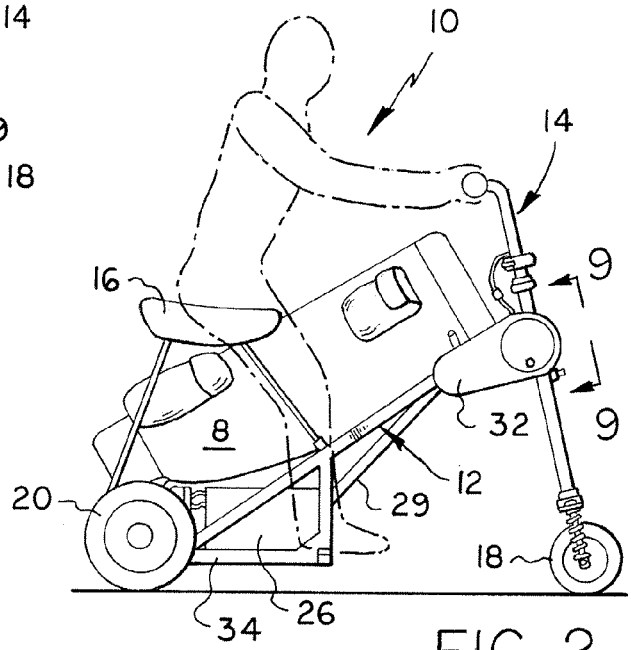
FIG. 2 is a side elevational view of the apparatus shown in FIG. 1, with a rider also indicated.
Figure 4:
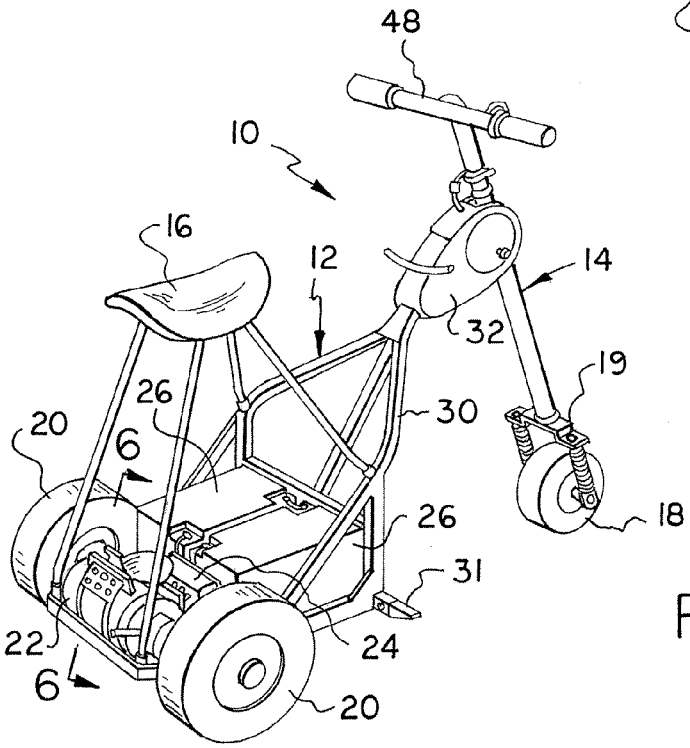
FIG. 4 is a rear perspective view of the apparatus.

In accordance with an improvement of the present invention, support legs 17 and seat 16 are arranged to straddle golf bag 8 supported on frame 12. Consequently, when apparatus 10 is being ridden by a user as shown in FIG. 2, it appears as though the user is riding the golf bag. This feature of the invention allows apparatus 10 to be very compact in size relative to other golf carts, whereby apparatus 10 may be stored in a car trunk or other small space; the removable seat also helps in this regard.

Motor 22 is coupled to one or both of rear wheels 20 for driving apparatus 10. Motor 22 is preferably an electric motor, but an internal combustion engine may also be used. A commercially available wheelchair drive motor with differential and emergency hill brake is known to provide suitable functionality for practicing the present invention. A particular drive motor assembly used by applicant in a prototype apparatus is a 600 W, 24 V DC electric motor transaxle, Model No. HLM-C01-600 available from Jinhua Huilong Machinery Co., Ltd. (China) (http://www.cn-hlm.com).

A motor control system connected to drive motor 22 includes motor controller 24, a throttle control 50 mounted on handlebar 48 and connected to motor controller 24 by a lead wire 70 extending along and secured to frame 12, and a motor control panel 72 connected by wires 74 to motor controller 24. Lead wire 70 preferably includes a plug connection 73 dividing the lead wire into upper and lower portions to accommodate removal of handlebar 48 as discussed above.

Motor controller 24 is shown mounted on platform portion 34, but it is also contemplated to mount motor controller 24 on central member 29 or elsewhere on frame 12. Motor controller 24 varies the drive output of motor 22 in response to an input signal from throttle control 50. Motor controller 24 may be a standard, commercially available electronic motor controller having reverse drive and braking functions. Motor controller 24 is preferably a programmable controller of a type commonly used in automatic wheelchairs and other personal mobility products. Such motor controllers are desirable because they provide several performance and safety features, including multiple speed modes, load compensation for maintaining constant speed when traveling up and down inclines, and anti-rolling functions. Another safety feature may be incorporated by connecting the locking pin 56 to motor controller 24 by a lead wire (not shown) so that frame 12 serves as ground, such that when locking pin 56 is removed from holes 60 an inhibit switch of the motor controller is tripped to prevent operation of the motor. A suitable motor controller known to applicant is the 24 V, 110 Amp Curtis 1228-2901 MultiMode™ electronic controller made by Curtis Instruments, Inc. of Mount Kisco, N.Y. Of course, if an internal combustion engine is used as a motor, it will require a controller adapted for use therewith.

Throttle control 50 is preferably a standard electronic throttle control that is responsive to rotation or other manipulation by a user. A currently preferred throttle control is a 5 V Hall effect throttle control. A standard potentiometer throttle control, or any throttle control adapted for use with motor controller 24, may be used.

FIG. 6 shows control panel 72 associated with motor controller 24. In the illustrated embodiment, control panel 72 includes an on/off switch 76, a power on status light 78, a forward/reverse switch 80, a fast/slow speed mode selection switch 82, and a brake/unbrake switch 84 for a parking brake.

In the embodiment shown in the figures, power sources 26 are two 12 V batteries connected to motor controller 24 by wires 86. The batteries are preferably absorption glass mat (AGM) batteries, which are relatively lightweight and reliable, and do not leak. If an internal combustion engine is used as the motor, the power source will be a fuel tank connected to the engine by a fuel line in a manner known to those having skill in the art.

As will be appreciated from FIGS. 2 and 13, apparatus 10 may function as a ridable golf cart (FIG. 2) or as a golf caddie for a player walking the golf course. To switchover from the ride position shown in FIG. 2 to the walk position shown in FIG. 13, a user removes locking pin 56 from holes 60, pivots steering assembly 14 about the pivot axis defined by pivot pins 42 to bring steering wheel 18 closer to rear wheels 20 until steering tube 40 abuts against outer casing 32, and then re-installs locking pin 56 through holes 60. The user also reverses the direction of handlebar 48 by pulling detent member 64 radially outward and rotating steering column 44 through 180° until detent member 64 can be released for receipt between second limit surfaces 68. In the golf caddie position shown in FIG. 13, apparatus 10 may be operated with motor assistance, or simply pushed or pulled along by a user without motor assistance. If the user chooses to walk behind apparatus 10 with motor assistance, as depicted in FIG. 13, it will be noted that forward/reverse switch 80 should be switched to operate motor 22 in reverse such that rear wheels 20 are leading the apparatus. For sake of clarity, the terms "ahead of" and "trails" and forms thereof as may be used in the claims refer to a rear of the apparatus established by rear wheels 20.

What is claimed is:

1. A combined golf caddie and golf cart apparatus comprising:

a) a frame configured to support a golf bag, the frame including an outer casing;

b) a steering assembly including:

i) a steering tube pivotally mounted to the outer casing of the frame; and ii) a steering colunm rotatably carried by the steering tube, the steering column having:

(1) a steering axle;

(2) a handlebar mounted on an upper portion of the steering axle; and (3) a steering wheel mounted on a lower portion of the steering axle;

wherein the steering assembly pivots with respect to the frame to adjust between a walk position in which the handlebar is ahead of the steering wheel and a ride position in which the handlebar trails the steering wheel;

c) a power source;

d) a motor coupled to the power source;

e) at least one drive wheel coupled to the motor and arranged to propel the frame; and f) a motor control system connected to the motor for varying drive output provided by the motor.

2. The apparatus according to claim 1, further comprising a seat mounted on the frame.

3. The apparatus according to claim 2, wherein the seat is removeably mounted on the frame.

4. The apparatus according to claim 2, wherein the seat is mounted on the frame by support legs, wherein the support legs and the seat straddle the golf bag supported by the frame.

5. The apparatus according to claim 1, wherein the frame includes a horizontal platform portion, and the power source is placed on the platform portion.

6. The apparatus according to claim 5, wherein motor is an electric motor and the power source includes a battery.

7. The apparatus according to claim 5, wherein the motor is a combustion engine and the power source includes a fuel supply.

8. The apparatus according to claim 1, further comprising locking means for releasably securing the steering assembly in the walk position and in the ride position.

9. The apparatus according to claim 8, wherein the locking means includes a removable pin arranged to extend transversely through aligned holes in the outer casing.

10. The apparatus according to claim 9, wherein the handlebar is removably mounted on the steering axle.

11. The apparatus according to claim 1, wherein the steering assembly further includes a detent member arranged to extend radially through the steering tube to partially reside between a pair of angularly spaced limit surfaces provided on the steering axle, whereby rotation of the steering column relative to the steering tube is limited to a predetermined angular range.

12. The apparatus according to claim 11, wherein the steering axle includes a first pair of limit surfaces spaced to limit rotation of the steering column relative to the steering tube to a predetermined angular range and a second pair of limit surfaces spaced to substantially prevent rotation of the steering column relative to the steering tube, wherein the detent member may be selectively positioned to partially reside between either the first pair of limit surfaces or the second pair of limit surfaces.

13. The apparatus according to claim 1, wherein the motor control system includes a throttle control on the handlebar.

14. The apparatus according to claim 1, wherein the frame further includes a pair of foot pegs, one on each opposite side of the frame.

15. The apparatus according to claim 1, wherein the frame further includes a bag stop member located to engage a bottom end of the golf bag supported by the frame.

16. A golf cart vehicle comprising a frame configured to support a golf bag and a seat for a rider connected to the frame, wherein the improvement comprises:

the seat being mounted on the frame by support legs, wherein the support legs and the seat straddle the golf bag supported by the frame, and the support legs include a pair of support legs releasably secured to the frame at separate locations on opposite sides of the golf bag, wherein the frame includes a pair of receptacles, one on each opposite side of the frame, and the pair of support legs are removably received by the pair of receptacles.

17. The improvement according to claim 16, wherein each of the pair of receptacles includes means for releasably securing a bottom end of a received support leg in the receptacle.

18. A combined golf caddie and golf cart apparatus comprising:

a) a frame configured to support a golf bag, the frame including
  i) an outer casing;
  ii) a bag stop member located to engage a bottom end of a golf bag supported by the frame; and
  iii) a horizontal platform portion;

b) a seat removably mounted on the frame to straddle a golf bag supported by the frame;

c) a steering assembly including:
  i) a steering tube pivotally mounted to the outer casing of the frame; and
  ii) a steering column rotatably carried by the steering tube, the steering column having:
    (1) a steering axle;
    (2) a handlebar mounted on an upper portion of the steering axle; and
    (3) a steering wheel mounted on a lower portion of the steering axle;

wherein the steering assembly pivots with respect to the frame to adjust between a walk position in which the handlebar is ahead of the steering wheel and a ride position in which the handlebar trails the steering wheel;

d) a power source placed on the platform portion of the frame;

e) a motor coupled to the power source;

f) a pair of rear wheels mounted on the frame, at least one of the rear wheels being coupled to the motor for propelling the frame; and g) a motor control system connected to the motor for varying drive output provided by the motor, the motor control system including a throttle control on the handlebar.

* * * * *